United States Patent [19]

Bowles

[11] Patent Number: 4,895,374

[45] Date of Patent: Jan. 23, 1990

[54] BOARD GAME FOR TEACHING MUSIC

[75] Inventor: Illene W. Bowles, Salt Lake City, Utah

[73] Assignee: Music Ed, Inc., Salt Lake City, Utah

[21] Appl. No.: 332,078

[22] Filed: Apr. 3, 1989

[51] Int. Cl.[4] ..... A63F 3/00

[52] U.S. Cl. ..... 273/249

[58] Field of Search ..... 273/249, 248, 243, 242, 273/269

[56] References Cited

U.S. PATENT DOCUMENTS

| | | | |
|---|---|---|---|
| 1,189,450 | 7/1916 | Hofer | 273/249 |
| 1,338,475 | 4/1920 | Za Haris | 273/242 |
| 2,086,864 | 7/1937 | Gerber | 273/248 |

FOREIGN PATENT DOCUMENTS

| | | | |
|---|---|---|---|
| 451954 | 10/1948 | Canada | 273/269 |
| 1453088 | 10/1976 | United Kingdom | 273/249 |
| 2148724 | 6/1985 | United Kingdom | 273/243 |

*Primary Examiner*—Edward M. Coven

*Attorney, Agent, or Firm*—Lynn G. Foster

[57] ABSTRACT

An educational board game in which music students learn the names of the lines and spaces on the musical staff and their corresponding keys on the keyboard, comprising a folding game board, a key finder, instruction cards, dice and various colored game pieces. The board has a peripheral playing path representing a grand staff. The measures of the grand staff are spaces, each space having several letter notes. A representation of a keyboard is also provided on the board wherein the keys correspond to the letter notes on the grand staff. The players are each given seven playing pieces, each piece representing a musical letter note A-G. The object of the game is to advance each piece around the grand staff, moving the allotted spaces or measures, then ultimately moving the pieces to the corresponding keys on the keyboard. Movement to the keyboard is determined by the corresponding relationship between a playing piece and a letter note on the measure occupied by the playing piece, or the following instructions or other procedures.

19 Claims, 6 Drawing Sheets

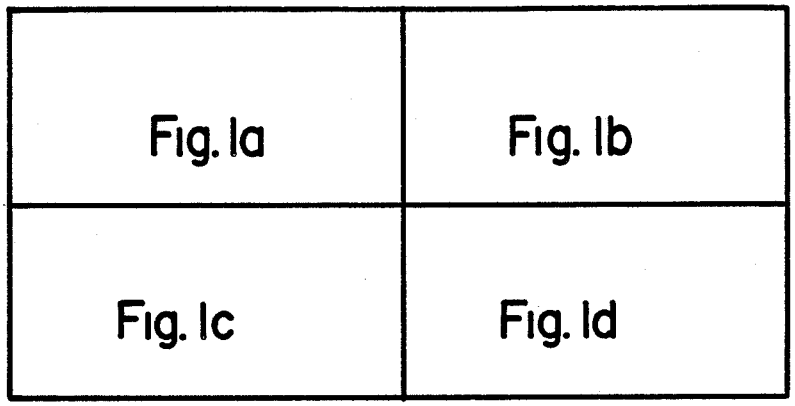
Fig. 1
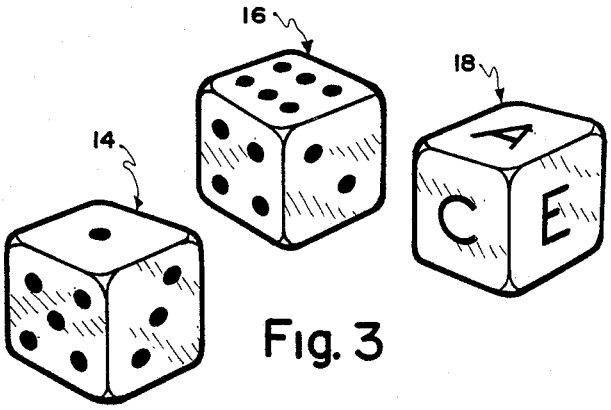
Fig. 3
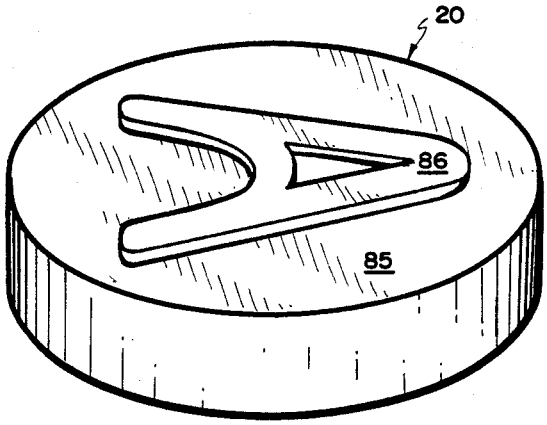
Fig. 4
Fig. 5
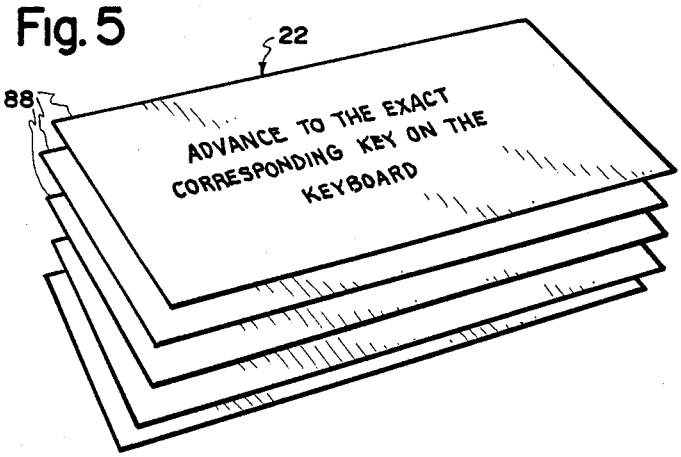

BOARD GAME FOR TEACHING MUSIC

FIELD OF INVENTION

The present invention relates generally to teaching systems and more specifically to a system, including apparatus and method, whereby a basic knowledge of musical scales and related skills are taught pursuant to an entertaining board game format.

PRIOR ART

Known methods for teaching music students the fundamental notes and scales necessary to read music generally comprise rigorous, and usually rather dull, exercises in memorization and/or repetition. While these methods are ultimately effective if followed closely, many students become bored or discouraged along the way, which often leads to their losing interest in learning music.

Some creative methods for assisting in the teaching of music fundamentals have been devised, such as the development of sentences in which each word of a sentence begins with a letter corresponding to the notes on either the lines or spaces of either the treble or bass clef. For example, the notes that are on the lines of the treble clef, taken in ascending order, are denoted by the letters E, G, B, D and F. The sentence "Every Good Boy Does Fine" is memorized by the music student to help in learning these notes. However, even methods such as these, while somewhat simplifying the process, do not fully alleviate the problems of boredom and lack of enjoyment associated with learning to read music.

BRIEF SUMMARY AND OBJECTS OF THE INVENTION

In brief summary, the present invention overcomes or substantially alleviates the problems associated with the prior art by providing a novel board game, and related method, which make learning begining musical concepts both interesting and enjoyable. In its presently preferred form, it comprises a playing board fashioned after the grand staff and piano keyboard, a key finder, three dice, instruction cards, and various colored playing pieces marked with the notes of the musical scale.

In the presently preferred game, each participant (the game is designed for two to four players) is assigned a color and given the seven playing pieces, or men, marked A through G, in that color. The object of the game is to advance each piece once around the board by rolling the dice, moving the allotted spaces or measures, and then following the instructions or procedures provided. One of the three dice is marked with letters rather than numbers and indicates which playing piece is to be affected by that turn or roll of the dice. Upon completion of one lap around the playing board, or as per specific direction provided by the instruction cards, a playing piece is placed on a corresponding key on the keyboard. For beginning players, the key finder is used to locate a proper key upon which a playing piece may be placed. The first participant to land all playing pieces on the keyboard wins the game.

With the foregoing in mind, it is a principal object of the present invention to provide a novel method of teaching the fundamentals of reading music in an interesting and enjoyable manner.

A further significant object of the present invention is the provision of a board game for use with two or more players which teaches the basic music scale and keyboard.

Another important object of this invention is to provide a method by which fundamentals of music are learned under an enjoyable game format by participants, none of whom need have a prior knowledge of such fundamentals.

Another principal object is the provision of a competitive board game which teaches music fundamentals and has the following advantages: easily learned, enjoyable, informative, easily manufactured, inexpensive and educational.

These and other objects and features of the present invention will be apparent from the detailed description taken with reference to the accompanying drawings.

BRIEF DESCRIPTION OF THE DRAWINGS

FIG. 1 is a diagrammatic illustration of the relationship of FIGS. 1*a*–1*d;*

FIG. 3 is an enlarged perspective view of the preferred dice used in connection with the presently preferred game board of FIG. 1, two of which are standard game dice and one of which comprises on its six sides the letters A through F;

FIG. 4 is an enlarged perspective view of one of the tokens, pieces, or men, used in connection with the game board of FIG. 1, which comes in one of four different colors and comprises the letters A through G of the standard music scale; and FIG. 5 is an enlarged perspective view of assorted instruction cards, used in connection with the presently preferred game board of FIG. 1.

DETAILED DESCRIPTION OF THE ILLUSTRATED EMBODIMENT

Figure 1A:
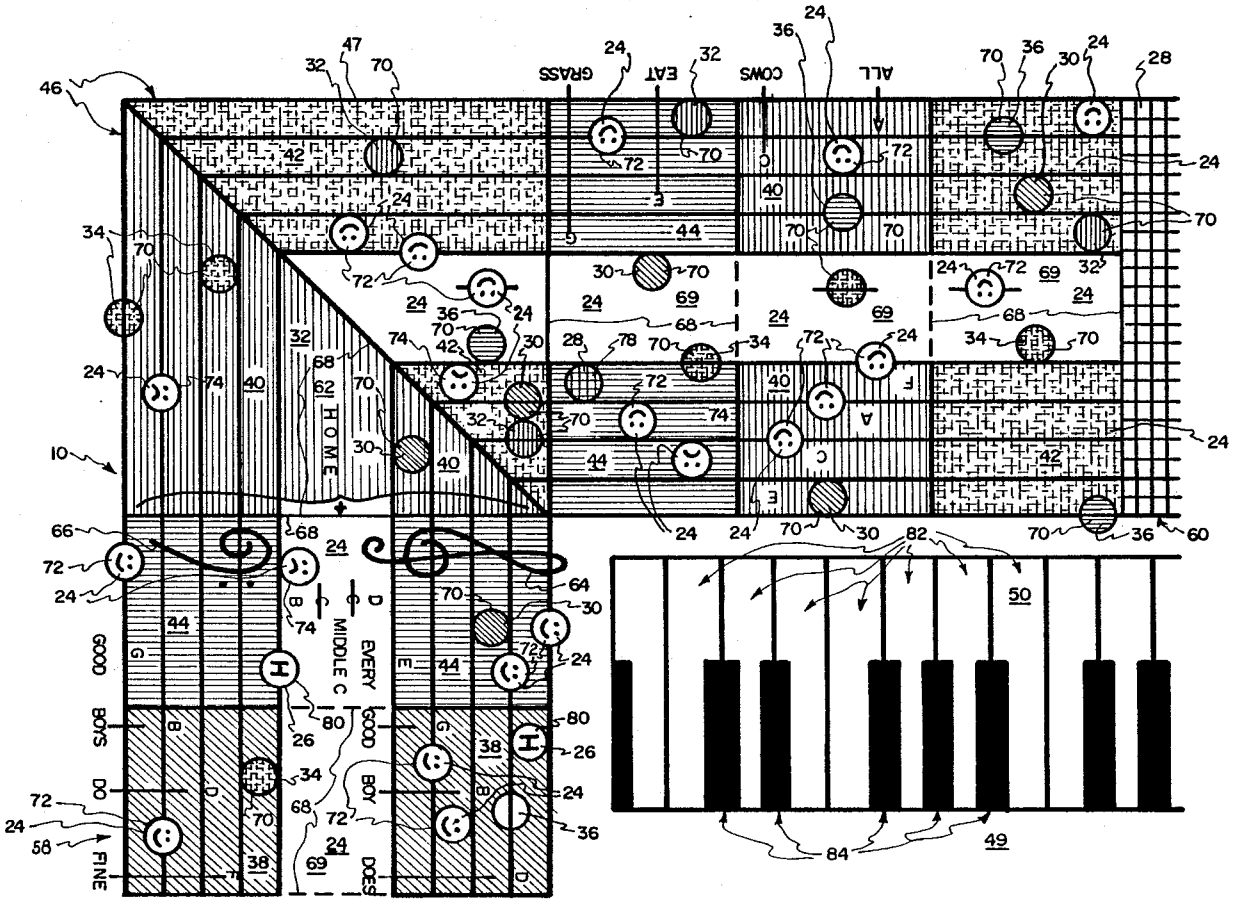
FIGS. 1*a*–1*d* are collectively a plan view illustratin presently preferred game board, according to the present invention, which assists in instructing music students in basic music reading skills.
Figure 1B:
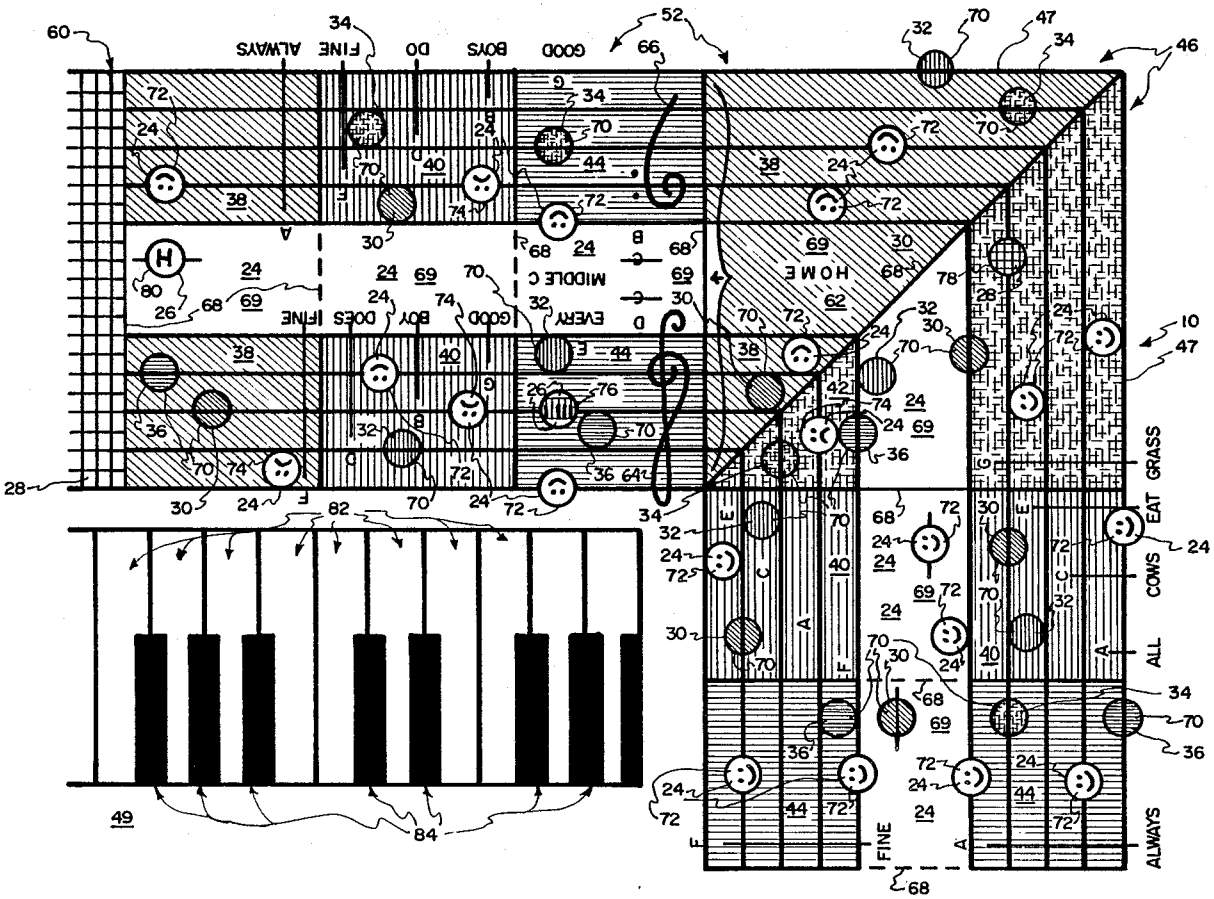
Figure 1C:
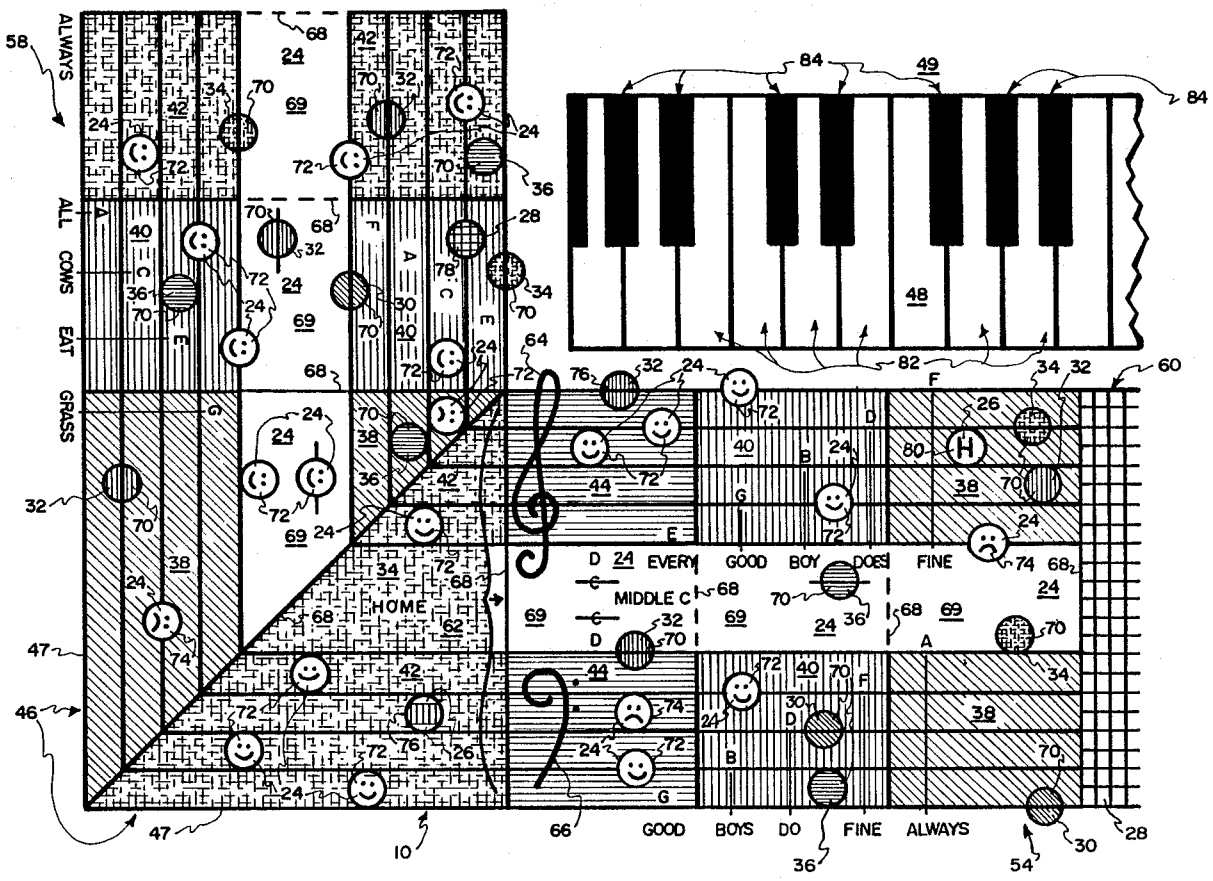
Figure 1D:
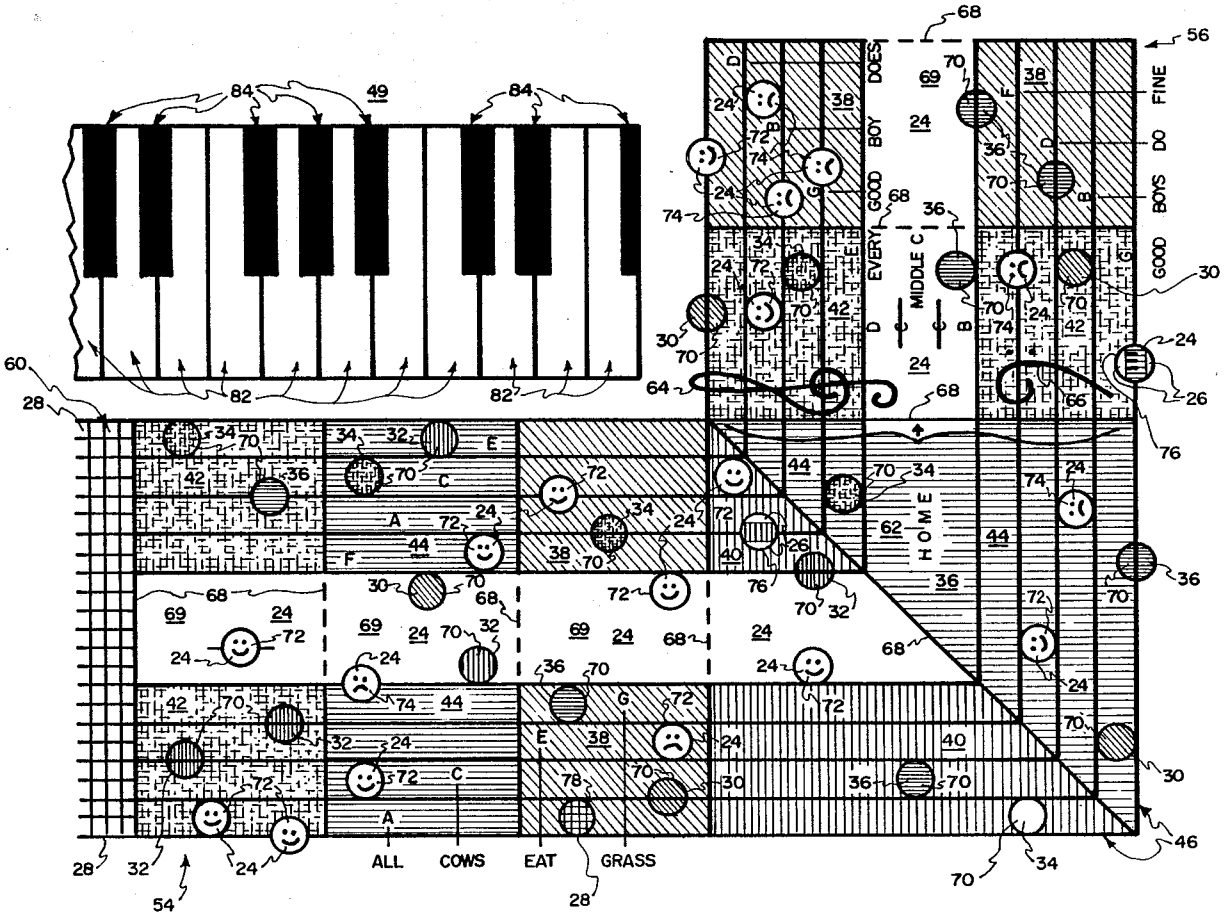

Reference is now made to the drawings, wherein like numerals are used to designate like parts throughout. The presently preferred game comprises a board, designated 10 (FIGS. 1–1*d*); a key finder, designated 12 (FIG. 2); three dice, designated 14, 16 and 18 (FIG. 3); a plurality of playing pieces or tokens, generally designated 20 (FIG. 4); and a stack of instruction cards, generally designated 22 (FIG. 5). Inasmuch as the use of color plays an important role in the present invention, the following color code table designates specific colors appearing on the top surface of the board 10 for description purposes:

| | | | |
|---|---|---|---|
| white | 24 | dark blue | 36 |
| black | 26 | light green | 38 |
| brown | 28 | light red | 40 |
| dark green | 30 | light yellow | 42 |
| dark red | 32 | light blue | 44 |
| dark yellow | 34 | | |

The game board 10 is understood when FIG. 1*a* through FIG. 1*d* are placed together as shown in FIG. 1. The game board 10 is illustrated as being rectangular and comprises generally a grand staff 46, and two oppositely directed keyboards 48 and 50. The grand staff 46 follows the perimeter 47 of the game board 10 and is thus rectangujlar in shape and is in a closed formation. While a rectangle is the preferred shape of the game board 10, it is recognized that many other shapes fall within the scope of the present invention.

Grand staff 46 comprises two long sides 52 and 54, and two short sides 56 and 58, as best shown in FIG. 1. Each of the two long sides 52 and 54 comprises a dungeon of discord 60, hereinafter more fully explained, located in the approximate center thereof. Each dungeon of discord 60 is displayed in FIG. 1 as a grid, symbolizing bricks one would expect to find in a dungeon. At one corner location at the end of each of the sides 52, 54, 56 and 58 is located a home area 62, which serves as a beginning or starting point for each participant.

Adjacent to the home areas 62 and located in their proper positions on the grand staff are a treble clef 64 and a bass clef 66. Thus, in the preferred embodiment there are four home areas 62, four treble clefs 64 and four bass clefs 66. Different sections of the grand staff 46 are divided by the lines 68 which divide the grand staff into different measures. Each measure has a different color, designated by the color table above, which is important in the playing of the game as hereinafter more fully described.

As is typical with the grand staff generally, a space 69 is located between the treble and bass staffs. In the space 69 or about the perimeter 47 of the grand staff 46 are located illustrations in the nature of helpful suggestions in learning and memorizing the musical scale. For example, on each of the four sides 52, 54, 56 and 58 of the game board 10 the letter names of the lines are shown at the left and the letter names of the spaces are shown at the right in both clefs. Phrases are also depicted which aid in remembering the names of the lines and spaces. For example, to aid in remembering the lines of the bass clef, the words "Good Boys Do Fine Always" correspond to the letters marking the lines. Also, each side 52, 54, 56 and 58 illustrates the correct position of Middle C, designated by a C with a line drawn through it. More particularly, in the treble clef Middle C is shown with a space designated D directly above it. And in the bass clef the space directly below Middle C is designated B, as best illustrated in FIG. 1.

The grand staff also comprises various circles distinguished by various markings or colors. Solidly colored circles are designated 70 and are colored according to the table given above. Circles depicting happy faces are designated 72, while circles depicting sad faces are designated 74. A few circles represent key boards and are designated 76, and a few represent brick work and are designated 78. Those designated 78 refer the participant to the dungeon of discord 60, already mentioned. Finally, some circles are black with a white H printed therein. These are designated 80. The purposes of circles 70, 72, 74, 76, 78 and 80, as well as the measures 68, home areas 62 and dungeons of discord 60 are described hereinafter in connection with the directions and rules of the game.

Keyboards 48 and 50 are located in the center area 49 of the rectangular grand staff 46. As is typical, each keyboard 48 and 50 comprises adjacent white keys 82 and variously spaced black keys 84, as shown in FIG. 1.

The dice 14 and 16 (FIG. 3) are standard cubical game dice with each of the six sides depicting the numerals 1 through 6. The third die 18 is also cubical. However, in contrast to the dice 14 and 16, each of its sides shows the letters A through F.

Each playing piece 20 (FIG. 4) has the general shape of a disk and somewhat resembles a miniature hockey puck. On the circular top 85 appears a letter of the musical scale A through G, designated 86 and best illustrated in FIG. 4. The playing pieces 20 come in four different colors. In each color there is a playing piece 20 with each letter A through G embossed thereon. There are, therefore, a total of 28 playing pieces 20, seven for each of four players.

Instruction cards 22 are simple rectangular cards, as shown in FIG. 5. Each individual card 88 is constructed of standard construction paper or a light cardboard. Instructions for the game are written thereon, as hereinafter more fully explained. Examples of other instructions which may be upon the respective cards 22 are set forth below:

| | |
|---|---|
| Advance to the blue home area. If that is your home or if you pass your home, advance to any key on the keyboard having the same name. | Advance to the green home area. If that is your home or if you pass your home, advance to any key on the keyboard having the same name. |
| Advance to the red home area. If that is your home or if you pass your home, advance to any key on the keyboard having the same name. | Advance to the yellow home area. If that is your home or if you pass your home, advance to any key on the keyboard having the same name. |
| Advance to the exact corresponding key on the keyboard. | Advance to any key on the keyboard having the same name. |
| Advance to the nearest measure with treble and bass clefs. | Move to the measure directly opposite you across the gameboard. |
| Advance to the next home measure. If this is your home stay there and work around the gameboard again. | If you have a G on the keyboard, move it to the Dungeon of Discord farthest in measures from your home. |
| Take another turn. | Go back home. |
| Move any man still at home to the next nearest home. | Move one of your men on the keyboard back home. |
| Move back to the nearest measure with a circle on the same line or space (not a happy or sad face). | Advance to the next measure with a circle on the same line or space (not a happy or sad face). If you pass your home go to the keyboard. |
| Stop at your home if you come to it before a circle. | |
| If you have a man in the Dungeon of Discord, advance him to any key having the same name on the keyboard. | If you have a G still at home, advance it to any G key on the keyboard. |
| You do not have to take a man off the keyboard. This card may be kept for future use. | Go to the Dungeon of Discord farthest in measures from your home. |
| If you choose, you may move an A man on the keyboard to a different A key. If your A is not yet on the keyboard you may keep this card for future use. | If you choose, you may move a C man on the keyboard to a different C key. If your C is not yet on the keyboard you may keep this card for future use. |
| If you choose, you may move an F man on the keyboard to a different F key. If your F is not yet on the keyboard you may keep this card for future use. | If you have a man in the Dungeon of Discord, he may move out when you shake his letter on the die. You do not have to take a man off the keyboard. |

Figure 2:
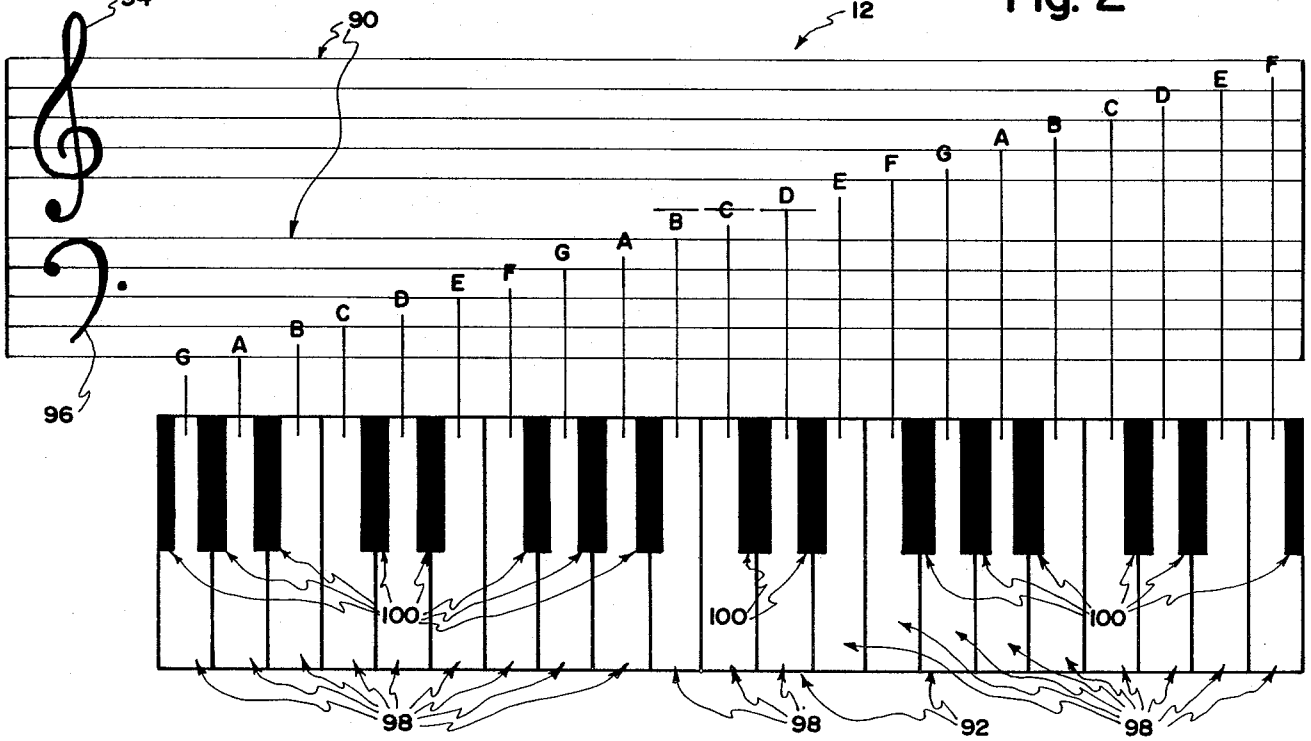
FIG. 2 is a plan view of a preferred key finder chart which may be used in connection with the game board of FIG. 1.

The key finder 12 (FIG. 2) comprises a grand staff 90 and a keyboard 92. Grand staff 90 comprises a treble clef 94, a bass clef 96 and notes of the musical scale printed in their proper ascending order from left to right. Keyboard 92 is standard and comprises white keys 98 and black keys 100. The keyboard 92 is situated adjacent to and directly below the grand staff 90, and the printed notes or letters of grand staff 90 are correlated to corresponding notes on keyboard 92, as shown in FIG. 2. The size of the key finder 12 must correspond to the size of the keyboard portion of the board 10.

To begin the game, the colored game pieces 20 are placed on the matching colored areas marked home 62 in the corners of the game board 10. Two, three or four players may play. Each player is given seven game pieces 20 of the same color marked A, B, C, D, E, F and G. Instruction cards 22 are placed in a stack face down at the site of the game board 10. The stack may be shuffled. The three dice 14, 16 and 18 are placed in the middle of the game board 10. Key finder 12 is typically used by novice players during the game and can be placed adjacent to or underneath the game board 10. Each player or participant initially rolls only the two standard game dice 14 and 16. The player rolling the high number goes first and others follow going either direction from the first player.

The first player begins by throwing all three dice, 14, 16 and 18. The die 18 informs which playing piece 20 a player may move: A, B, C, D, E or F. The other dice 14 and 16 collectively indicate the number of measures the player must move. Playing pieces or tokens 20 move counter-clockwise from measure to measure staying between the treble clef lines and the bass clef lines in the space 69. The dungeon of discord 60 does not count as a measure and is skipped over during movement of token. Home areas 62, although triangular in shape, are treated as normal measures and opponents may land there.

The letter G cannot be thrown on the die 18. In order for a player to move the G token 20, the player must have tokens on the keyboard 48 or 50. If the player throws a D, for instance, and the D piece 20 is already on the keyboard 48 or 50, the G token 20 may be moved the number of spaces the D token 20 would have moved. If a player throws the letter of a token 20 that is on the keyboard 48 or 50 and the G token 20 is already on the keyboard, too, the player may roll the dice once again to try to move a different token 20. Whenever a player throws the letter of a token 20 he cannot use, the player may have one more throw. If the player cannot use the second throw the player's turn is forfeited.

As indicated, within each measure 68 there are colored circles 70, circles with happy faces 72 or sad faces 74, circles with a keyboard 76, circles with brick work 78 resembling the decor of the dungeon of discord 60, and black circles 80 with a white H standing for the word "HOME." Upon landing in a measure 68, the player determines whether there are circles 70, 72, 74, 76, 78 or 80 on any lines or spaces within that measure 68 having the same identification as the token 20. For example, if a B token 20 lands in a certain measure 68, the player locates the lines or spaces that are also identified as B. On the full or grand staff 46 there will be three lines and/or spaces with the same name. If a B token lands in a measure that has a yellow 34, green 30, red 32 or blue 36 circle 70 on a B line or space, the player places the B token 20 on that circle 70. If the circle 70 is not the same color as the B token 20, the player draws a card 88 from the stack of instruction cards 22 and completes whatever action is indicated. After using a card 88, it is placed on the bottom of the stack 22. If a card 88 cannot be used, the player returns it to the bottom of the stack 22 and does not draw again. Some cards 88 can be kept for future use. At the time one of these cards 88 is used, it is placed back in the bottom of the stack 22.

If the B token 20 lands on a circle 70 that is the player's color, the player does not draw a card 88 but may go to the keyboard 48 or 50. To do this the player takes note of the line or space the token is on in the treble or bass staff and then lines up the key finder 12 with the keyboard 48 or 50, locates that line or space on the key finder 12 then moves the token 20 to the white key 82 which corresponds to that line or space. The key finder 12 is held at the back of te keyboard 48 or 50.

If a player 20 lands in a measure 68 that has a happy face 72 on a line or space having the same letter identification as the token 20 the token is placed on the happy face 72. The token is then moved forward on that same line or space until the token reaches a measure 68 with another circle 70, 76, 78 or 80 on that line or space. A token cannot be advanced from one happy face 72 or sad face 74 to another but must pass over them until it comes to another circle 70, 76, 78 or 80 of the same type. The player then completes the action called for by that type of circle. If a token 20 comes to its home area 62 before completing a forward move, the token does not continue to move, but goes to one of the three keys on the keyboard 48 or 50 having the same letter identification as the piece 20 in question. If a token lands on a sad face 74, the token 20 is moved backwards upon that same line or space until it reaches a circle 70, 76, 78 or 80 other than a happy face 72 or sad face 74. The action indicated for that circle is then taken. If a token returns to its home area 62 before completing a backward move, the token stops there. The token is not to be moved backwards past its home area 62. As illustrated in FIG. 1, the corner measures 68 are triangular. Tokens moved from happy faces 72 or sad faces 74 simply follow lines and spaces around those corners.

If a player's piece 20 lands on a circle 76 with a keyboard, that player and the opponents may all place their pieces 20 with the same letter identificaton on the keyboard 48 or 50. For example, if a G piece 20 lands in a measure with a keyboard circle 76 on a G line, all players may place their G pieces 20 on the key 82 that corresponds to the G line.

If a player's piece 20, of a specific letter, lands on a circle 78 portraying the brick work found in the dungeon of discord 60, that player and all opponents must place all their correspondingly lettered pieces 20 in the dungeon 60 farthest in measures from their respective home areas 62. For example, if an E piece 20 lands in a measure with the dungeon circle 78 on an E space, all players must place their E pieces 20 in the dungeon 60 farthest from their home area 62.

If a player's piece 20 lands on a black circle 80 with an H in the middle he is not affected, but any tokens of opponents which are on the key 82 that correspond with the line or space of the H circle 80 must go back to their home area 62. When a piece 20 lands in a measure 68 with no circles 70, 72, 74, 76, 78 or 80 on lines or spaces with his letter name, that player's turn is finished. The token must remain in the area 69 between the treble clef lines and the bass clef lines. However, when there is a circle 70, 72, 74, 76, 78 or 80 with the corresponding letter name it must be used. If a piece 20 is directed by a card 88 to go to another measure 68 during a given turn, that piece may be located on corresponding circles 70, 72, 74, 76, 78 or 80 in the second measure 68. Upon landing in any measure 68, no matter how many in one turn, the appropriate circles 70, 72, 74, 76, 78 or 80 to land on must be identified and used. This does not apply in sliding from happy faces 72 and sad faces 74, because the piece 20 automatically lands on a circle 70, 76, 78 or 80 after completing a move.

Some measures 68 have more than one circle 70, 72, 74, 76, 78 or 80 on lines and spaces having the same letter name. In this case, a player may choose which one he would like to land on. A happy face 72 is usually better than a colored circle 70, unless a piece 20 can land on a circle 70 having the same color. In the measures 68 where the keyboard 76, dungeon 78 and H circles 80 are located, there are no other options. If a piece 20 lands on a circle 70, 72, 74, 76, 78 or 80 and an opponent's piece 20 is already on it the incoming token must move on that line or space to the next circle 70, 72, 74, 76, 78 or 80.

Players position their pieces 20 on whichever keyboard 48 or 50 best faces them. When there are three or four players, two players will share one keyboard 48 or 50. The first player to get all seven pieces 20 upon the keyboard 48 or 50 wins. The other players may continue to play for second, third and fourth places.

There are four different ways a player can get a token on the keyboard 48 or 50. First, by landing on a circle 70 the color of the piece 20. In this case, the piece 20 always goes to the key 82 that corresponds exactly to the line or space on which the circle is disposed. Second, by drawing a card 88 which sends the token to the keyboard 48 or 50. A card 88 can direct the token to the exact corresponding key 82 or to any key 82 having the same letter name as the piece 20. Third, by making one revolution around the game board 10. Since the piece 20 is on no particular line or space when it goes to the keyboard 48 or 50 through the home area 62, the token may go to any key 82 having the same letter name as the piece 20. When a piece 20 has gone completely around the board 10 and is approaching the home area, the exact number required to get into the home area 62 does not have to be thrown on the dice. Any number that will bring the token home or past home puts the token on the keyboard 48 or 50. Fourth, by landing a token on a circle 76 with a keyboard in it in which case all tokens 20 of the same letter designation go to the key that corresponds exactly with the line or space on which the circle 76 is disposed.

Players should try to arrange their pieces 20 on the keyboard 48 or 50 as close to each other as they can, because if a player gets three pieces 20 in succession on the keyboard 48 or 50 that player may add another piece 20 of his choice. If a player gets 6 tokens 20 in succession that player may add another token 20, thus, winning the game.

Some cards 88 can be kept by the players during the game and used later for rearranging certain pieces 20 on the keyboard 48 or 50. At the time the rearranging is done the card 88 is put back at the bottom of the stack 22. The card 88 must be used during one of the player's turns.

When a piece 20 goes to the dungeon of discord 60, that token always goes to the one farthest in measures from the home area 62. There are two ways that a piece 20 can be sent to the dungeon of discord 60. First, by drawing a card 88 which sends the token to the dungeon 60. Second, by any player landing on a dungeon circle 78. All player's pieces 20 having the same letter name as the line or space on which the circle 78 is disposed must go to the dungeon 60.

There are two ways that a piece 20 can get out of the dungeon of discord 60. First, by removing a token from the keyboard 48 or 50. When the letter of the piece 20 in the dungeon 60 is thrown, the token is moved from the dungeon 60 the number of measures 68 indicated on the dice 14 and 16 and a token 20 on the keyboard 48 or 50 is put back into its home area 62. If there are no tokens 20 on the keyboard 48 or 50, the piece 20 must stay in the dungeon 60 and forfeit any turns where the same letter on the die 18 is thrown. Remember, a player may always throw a second time if the first throw cannot be used. Players cannot choose to stay in the dungeon 60, but must leave when their letter is thrown if there is a piece 20 on the keyboard 48 ir 50.

The second way a piece 20 is released from the dungeon is by use of a card 88 which releases the piece 20. Cards 88 may be kept by the players to be used at a time when a piece 20 is in the dungeon 60. They are returned to the bottom of the stack 22 at the time the token 20 leaves the dungeon 60. A piece 20 cannot leave the dungeon 60 with a release card 88 until the corresponding letter is thrown on the die 18.

There are two different types of release cards 88. One sends the piece 20 in the dungeon 60 the number of measures 68 shown on the dice 14 and 16. The other sends the token 20 from the dungeon 60 at the time the corresponding letter name is thrown to any key 82 on the keyboard 48 or 50 having the same letter name. When this card 88 is used, the amount shown on the dice 14 and 16 is disregarded. It is important to realize that a piece 20 is safe from going to the dungeon 60 when it is in a measure 68 of its own color.

The invention may be embodied in other specific forms without department from the spirit or essential characteristics thereof. The present embodiment, is, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by United States Letters Patent is:

1. game structujre by which the correlation between notes depicted on tokens, the grand staff and keys of a piano keyboard is taught, the game structure comprising:

a display comprising a first area comprising piano keyboard representation means and a second area comprising grand staff representation means;

the grand staff representation means being subdivided into measure means comprising symbol means selectively calling for predetermined action to be taken wherein some of said symbol means representing musical letter notes on said grand staff and other information to players of the game and comprising a loop configuration;

a set of tokens for each player to use in moving from a start location around the loop configuration of the grand staff means and thence to the piano keyboard representation means, the respective tokens carrying at least one musical note letter corresponding to said symbol means thereon;

a set of dice, one of which carries six music note letters on its respective side, corresponding to the musical note letters on said tokens and at least one which carries six numerals on its respective sides, the roll of the dice controlling token movement and the magnitude of each such movement, along the measures of the grand staff, the keys of said piano keyboard corresponding to the musical note letters of said tokens and musical letter notes of said symbol means, said keys are finishing spaces wherein the tokens move from their respective symbol means to their respective keys.

2. Game structure according to claim 1 further comprising key finder means comprising note indicia correlative with said piano keyboard representation means.

3. Game structure according to claim 1 wherein the piano keyboard representation means comprise a central portion of the display.

4. Game structure according to claim 1 wherein the grand staff representation means comprise a non-central perimeter portion of the display.

5. Game structure according to claim 1 wherein at least some of the tokens and symbol means are correspondingly color coded.

6. Game structure according to claim 1 further comprising instruction cards selectively used to control movement of tokens upon the display.

7. A board game used to instruct beginning music students in the basics of reading music comprising:

a generally rigid, rectangular game board comprising a display comprising a multi-colored grand music staff loop comprising measure representations and a series of landing spots on said measure representations, said landing spots each representing a musical letter note of the musical scale, and further comprising at least one piano keyboard representation juxtaposed the grand music staff loop said piano keyboard having keys corresponding to each of said letters of the musical scale;

a plurality of game dice for controlling the movement of the game pieces along said measure representations; and a plurality of various colored game pieces for each player, each of which is embossed with one of said letters of the musical scale said keys are finishing spaces wherein said game pieces move from their respective landing spots to their respective keys.

8. A board game used to instruct music students in the basics of reading music according to claim 7 wherein said game board comprises fold means by which the board is folded upon itself to decrease space taken during storage.

9. A board game used to instruct music students in the basics of reading music according to claim 7 wherein said grand music staff is in the form of a rectangle.

10. A board game used to instruct music students in the basics of reading music according to claim 7 wherein three game dice are used, two of said dice comprising standard cubes, each side of said cube comprising numerals one through six, and the third die comprising a standard cube, each side of said cube representing musical letters A through F.

11. A board game used to instruct music students in the basics of reading music according to claim 7 wherein two opposed musical keyboards are situated in the center of said game board.

12. A board game used to instruct music students in the basics of reading music according to claim 7 further comprising a portable key finder which correlates the notes of the grand staff to the keys of a musical keyboard, said key finder comprising a grand staff upon which the letters or notes of a scale printed thereon and a standard musical keyboard, a line being drawn between the notes on the grand staff and corresponding keys on the keyboard.

13. A board game used to instruct music students in the basics of reading music according to claim 7 wherein the game piees comprise small disks embossed with a letter representing a note on the musical scale.

14. A board game used to instruct music students in the basics of reading music according to claim 7 wherein the landing spots on the game board comprise circular whole notes.

15. A board game used to instruct music students in the basics of reading music according to claim 14 wherein said circular landing spots comprise a keyboard, a smiling face, a frowning face, an "H", a brick wall, or any of a number of colors.

16. A method of entertainingly learning musical notes in correlation with a piano keyboard comprising the steps of:

providing a display having a piano keyboard representation and a grand staff representation divided into measure representations and comprising visual musical indicia;

providing a plurality of tokens comprising note indicia and dice comprising numerical indicia and note indicia;

successively rolling the dice thereby identifying the length of each move and which token is to be moved along the grand staff representation;

correlating the visual musical indicia of the grand staff representation at sites where tokens are disposed at various points in time with the note indicia of the tokens and in turn further correlating with the note sites of the piano keyboard representation during transfer of a token from the grand staff representation to the keyboard representation.

17. A method according to claim 16 further comprising said transfer by use of a portable key finder.

18. A method according to claim 16 selectively controlling at least some of said moves and transfers by access to instructional cards.

19. A method of teaching students the fundamentals of musical notes and scales, comprising the steps of:

providing a game board comprising the representation of a grand staff divided into a plurality of spaces arranged in a clossed formation and at least one representation of a keyboard, said grand staff having musical letter notes corresponding to the keys of said keyboard;

providing dice, plurality of playing pieces each representing a musical letter note corresponding to the musical letter notes of said grand staff, instruction cards and a key finder which comprises a grand staff upon which the letters or notes of a scale have been printed in the appropriate position and a standard musical keyboard, a line being drawn between the notes on the grand staff and corresponding keys on the keyboard;

rolling the dice to determine which playing piece is to be moved and how many spaces to move it on the game board;

moving the designated playing piece the allotted sapces;

placing each playing piece on a corresponding musical letter note on said grand staff as provided by the rules of the game, following instruction given by the instruction cards and as provided in the rules of the game;

placing each playing piece on a corresponding key of said keyboard of the game board according to instruction provided by the rules of the games and instruction cards or upon completion of one revolution around the enclosed grand staff.

* * * * *